US005896727A

United States Patent [19]

Egli et al.

[11] Patent Number: 5,896,727

[45] Date of Patent: Apr. 27, 1999

[54] METHOD AND APPARATUS FOR REMOVING AND DISPLACING PACKAGE HEADSPACE STERILIZED AIR

[75] Inventors: Josef Egli, Hünibach; Willy Hugelshofer, Konolfingen; Alfred Messerli, Grosshöchstetten, all of Switzerland

[73] Assignee: Nestec S.A., Vevey, Switzerland

[21] Appl. No.: 08/849,496

[22] PCT Filed: Dec. 5, 1995

[86] PCT No.: PCT/CH95/00290

§ 371 Date: Aug. 22, 1997

§ 102(e) Date: Aug. 22, 1997

[87] PCT Pub. No.: WO96/17775

PCT Pub. Date: Jun. 13, 1997

[30] Foreign Application Priority Data

Dec. 6, 1994 [EP] European Pat. Off. ..... 94119203

[51] Int. Cl.[6] ..... B65B 55/02; B65B 31/04

[52] U.S. Cl. ..... 53/426; 53/432; 53/434; 53/510; 53/167

[58] Field of Search ..... 53/432, 433, 434, 53/510, 511, 425, 426, 167

[56] References Cited

U.S. PATENT DOCUMENTS

| | | | |
|---|---|---|---|
| 3,486,295 | 12/1969 | Rausing et al. | 53/432 X |
| 3,942,301 | 3/1976 | Domke | 53/510 X |
| 4,081,942 | 4/1978 | Johnson | 53/511 X |
| 4,788,811 | 12/1988 | Kawajiri et al. | 53/426 |
| 4,869,047 | 9/1989 | Nishiguchi et al. | 53/432 |
| 4,926,613 | 5/1990 | Hansen | 53/433 |
| 4,934,127 | 6/1990 | Risko et al. | 53/511 |
| 5,271,207 | 12/1993 | Epstein et al. | 53/432 |

FOREIGN PATENT DOCUMENTS

| | | |
|---|---|---|
| 479037 | 4/1992 | European Pat. Off. . |
| 3108817 | 9/1982 | Germany . |

*Primary Examiner*—Linda Johnson
*Attorney, Agent, or Firm*—Vogt & O'Donnell, LLP

[57] ABSTRACT

Aseptic filling and sealing of packages with a food product is carried out in compartments which contain an atmosphere of sterile air and which contain devices for filling and sealing packages and a transporter device for transporting the packages through the compartments for the filling and sealing operations. Headspace sterile air is removed and displaced from the packages by injection of nitrogen into the packages from a nozzle which is at a fixed position and which directs the nitrogen at an angle with reference to a vertical perpendicular to the horizontal package transport direction and counter to the transport direction.

12 Claims, 1 Drawing Sheet

9
6
7
12
4
5
13
11
15
10
3
14
17
8
2
1
16
1

9
6
7
12
4
5
13
11
14
15
3
17
2
1
16
1

METHOD AND APPARATUS FOR REMOVING AND DISPLACING PACKAGE HEADSPACE STERILIZED AIR

BACKGROUND OF THE INVENTION

The invention relates to process and apparatus for aseptically filling a package with a product under an atomosphere of sterile air containing oxygen and for removing and displacing the sterile air from the headspace of the filled package with nitrogen and for sealing the package so that the sealed, filled package headspace contains the nitrogen.

In the field of aseptic filling using certain types of machines, it is not possible to fill a package and seal it without leaving in it a small volume of gas, called headspace gas. As systems are normally used with sterile air, this headspace contains about 20% of oxygen. The presence of oxygen has a negative effect in the sense that, during preservation of the product contained in the package, it frequently happens that the product is sensitive to oxygen, which thus leads to degradation of its taste and/or of certain ingredients, such as vitamins and mineral salts. This phenomenon is unacceptable for the consumer, or for food legislation reasons.

One solution for reducing headspace air involves replacing the air with steam just before sealing. However, the drawback of this system is that the steam condenses on cold surfaces, the consequence being unacceptable risk of infection for neutral or slightly acidic products. A second solution consists in reducing the headspace by means of mechanical elements pressing the package, but it is not possible to remove the headspace air completely. German Patent Application Publication No. 31 08 817 also relates to a device enabling oxygen to be removed from the headspace of a package. In this device, the nozzle enabling the nitrogen to be injected is fastened to one of the sealing elements, thereby decreasing the efficiency of the nitrogen supplied since the nozzle moves and the stream of nitrogen changes direction. U.S. Pat. No. 4,934,127 and European Patent Application Publication No. 0 479 037 also relate to devices for removing the oxygen from the headspace of a package. The drawback of these devices is that the sealing of the package takes place downstream of the nitrogen injection station, this having the effect of allowing the quantity of nitrogen introduced beforehand to be distributed.

SUMMARY OF THE INVENTION

The object of the present invention is to develop a method which makes it possible to remove, in an efficient manner, the sterile air containing oxygen from the headspace of an aseptically filled package. "Remove" is meant to mean the fact of achieving a very low oxygen content in the headspace, namely about 2%, or even less.

According to the method of the invention, sterile nitrogen is ejected from a nozzle, which is fixed and placed between two movable package sealing elements which are moved together for sealing, and injected into the headspace for removing and displacing the sterile air with the nitrogen.

The method comprises aseptically filling a package having two movable sealing elements about a package opening with a product under an atmosphere of sterile air, wherein sterile air is present within a package headspace, and at room temperature and atmospheric pressure, injecting sterile nitrogen from a fixed nozzle, wherein the nozzle is positioned above the package opening between the movable sealing elements, into the package opening and headspace and moving the package sealing elements to seal the elements and the package.

The invention further provides apparatus for implementing the method wherein the apparatus comprises compartments wherein a package having two movable sealing elements us filled with a product wherein the sealing elements are sealed to seal the package and comprises a transporter device for conveying the package into and through the compartments and wherein the compartment in which the package is sealed includes a fixed nozzle positioned for injecting sterile nitrogen between the movable sealing elements into the package headspace.

DETAILED DESCRIPTION OF THE INVENTION

In the context of the present invention, the method is carried out and the apparatus provides for an aseptic filling mode wherein the air and nitrogen employed are presterilized. In the apparatus of the invention, the transporter system is a stepped-advance system which provides for achieving a conventional filling rate, and the package used may be of any type provided that, when filled, its upper part is sealable.

The product which fills the package may be of any liquid type in the food field, for example a milk-based, fruit-juice-based or water-based product, and may furthermore contain a portion comprising separate pieces. Most particularly, oxygen-sensitive and slightly acidic products, such as dietetic products containing vitamins and mineral salts, are preferred. The object is to obtain products which have a long preservation time and in which there is no degradation of the taste and/or of certain ingredients during storage.

The method is implemented on a conventional industrial manufacturing line in which there are, especially, a filling compartment and a sealing compartment, and according to the invention, it is necessary to add a nitrogen injection step in the sealing compartment.

The filling and sealing compartments are subjected to a stream of sterile air so as to create turbulent conditions therein, and the rate of injection of the nitrogen is greater than the rate of injection of sterile air. In order to achieve a headspace having an oxygen content of less than 2%, it is necessary to work with a nitrogen flow rate per line of between 100 and 800 l/min at atmospheric pressure.

The duration of nitrogen injection per package is about one second. This rapid nitrogen injection makes it possible to be sparing with the quantity of nitrogen and limits the length of the production line. It is equally possible to operate with a continuous nitrogen supply as with a discontinuous nitrogen supply.

The efficacy of removal of the residual air from the headspace is improved by means of a specific arrangement of the supply of the nitrogen stream, that being wherein the nitrogen is supplied from the top at an angle of between 40 and 50° with respect to the vertical and with a flow counter to the direction of movement of the packages.

Further in the apparatus of the invention, placed in the nitrogen supply nozzle are a distributor and additional means, such as one or more metal plates, which enable uniform flows at the outlet of the nozzle to be obtained.

It is also necessary that the flow of nitrogen be supplied over a sufficient width in order to displace the residual air in the headspace properly, and provision is made for the nozzle to have a width greater than the width of the opening in the package.

The rest of the description is given with reference to the drawings.

BRIEF DESCRIPTION OF THE DRAWING FIGURES

DETAILED DESCRIPTION OF THE DRAWING FIGURES

Figure 1:
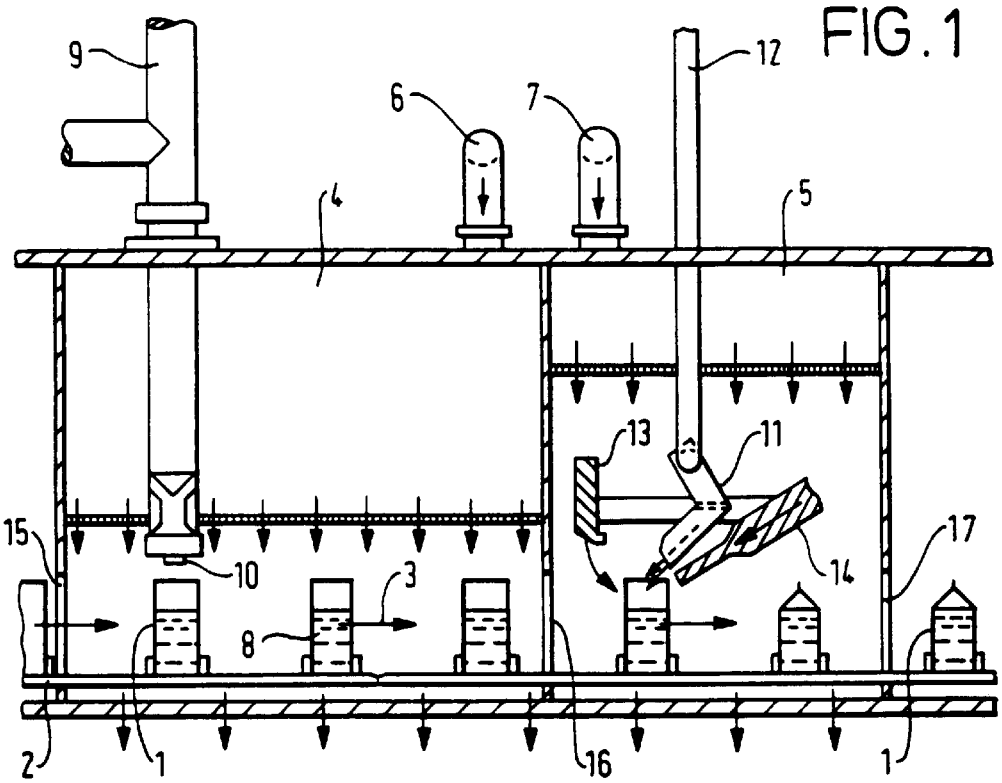
FIG. 1 illustrates apparatus according to the invention in the nitrogen-injection step.

As illustrated in FIG. 1, packages 1 are supplied by the transporter device 2 in the direction of the arrows 3 into the aseptic filling compartment 4 and then into the sealing compartment 5. Sterile air is injected into the two aforementioned compartments, respectively, via the pipes 6 and 7. The product 8 is supplied via the filling system 9 and is metered into the package 1 by means of the filling nozzle 10. The sealing compartment 5 comprises the fixed nitrogen injection nozzle 11, the nitrogen being supplied via the pipe 12, and comprises the two sealing elements 13, 14.

The aseptic filling compartment 4 and the sealing compartment 5 include openings 15, 16 and 17 through which the packages 1 on the transporter device 2 may pass.

Figure 2:
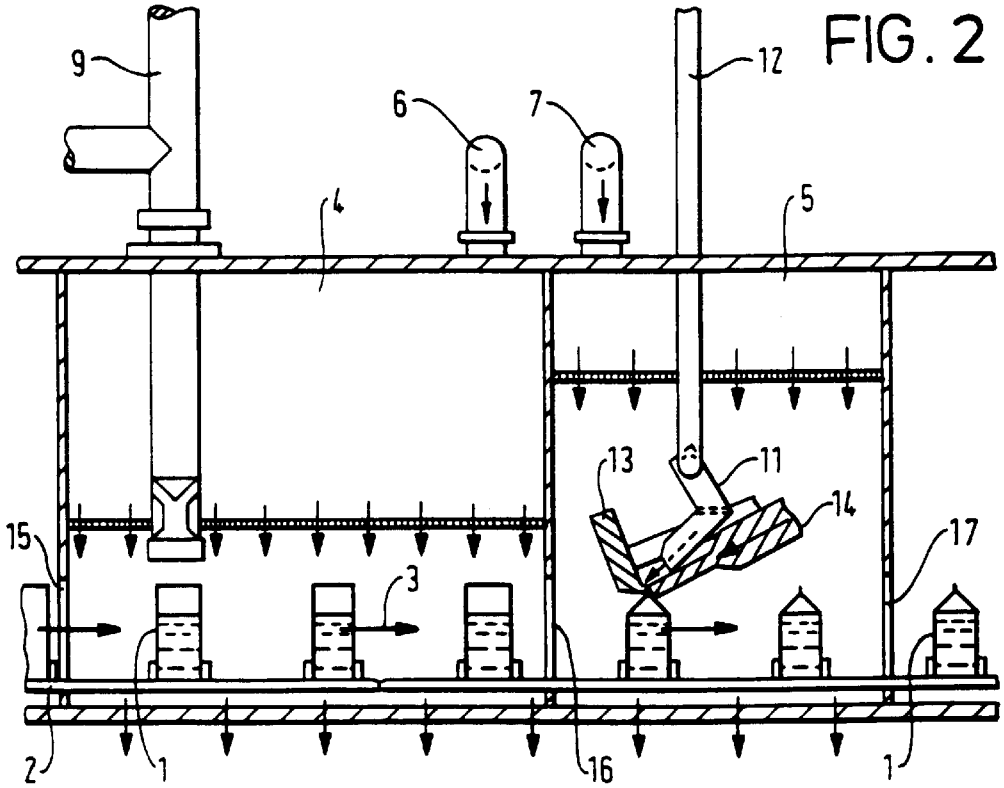
FIG. 2 illustrates the same apparatus as FIG. 1 at a time when the sealing device seals a package.

In operation, package 1 is positioned by the transporter device, which has a stepped-advance system, under the filling nozzle 10, which then delivers the metered quantity of product 8. The compartment is permanently under an atmosphere of sterile air. Next, the transporter device positions the other packages under the nozzle 10, and the filled packages are supplied into the sealing compartment 5 and pass under the nitrogen injection nozzle 11 which, as illustrated, is positioned, with reference to a vertical perpendicular to the horizontal package transport on transporter 2, to direct the nitrogen gas into the package headspace at an angle to the vertical perpendicular and counter to the direction of package transport. The nitrogen flow rate is 300 l/min, and the sealing compartment is under an atmosphere of sterile air. The operation of sealing with the elements 13 and 14 is illustrated in FIG. 2 which, as compared with FIG. 1, shows the sealing elements after they have been moved together to seal the package, and after sealing, the transporter device 2 delivers the packages ready for use or for storage.

According to the invention, packages are obtained which may be stored for at least 6 months, without any degradation in the quality and taste of the product. Furthermore, vitamins and mineral salts are preserved, and in the example above, an oxygen content of 1% in the headspace is achieved.

We claim:

1. In an apparatus for aseptically filling packages with a product and for sealing the packages wherein the apparatus comprises compartments containing an atmosphere of sterile air, a device for filling packages with a food product, a device comprising two movable sealing elements for sealing packages having two sealing elements and a nozzle device positioned at a position between the two movable sealing elements for injecting sterile nitrogen gas into package headspace for removing and displacing sterile headspace air during sealing and comprises a transporter device for transporting the packages in a direction horizontally through the compartments for filling and sealing, the improvements comprising:

the nozzle device being in a position fixed, with reference to the horizontal package transport direction, vertically above the transporter device so that the sterile nitrogen gas is ejected from the nozzle and injected into the package headspace, with reference to a vertical perpendicular to the transporter device and the horizontal transport direction, at an angle and counter to the transport direction.

2. An apparatus according to claim 1 wherein the angle is between 40° and 50°.

3. In a process for aseptically filling packages with a product wherein compartments contain an atmosphere of sterile air and wherein packages are transported through the compartments for filling and sealing, first filling a transported package with a product, wherein the package filled contains headspace sterile air, and transporting the filled package horizontally to a nozzle positioned for injecting nitrogen gas between two movable sealing elements and at atmosphere pressure and room temperature, injecting sterile nitrogen gas from the nozzle into package headspace and between the sealing elements for displacing headspace sterile air and moving the movable sealing elements together for sealing the package sealing elements, the improvements comprising:

ejecting the sterile nitrogen gas from a nozzle maintained in a fixed position and so that the gas is injected into the package headspace in a direction at an angle to a vertical perpendicular of and counter to the horizontal direction of package travel to displace sterile headspace air with the sterile nitrogen gas and sealing the package so that the sealed package contains the sterile nitrogen gas.

4. A process according to claim 3 wherein the angle is between 40° and 50°.

5. A process according to claim 3 or 4 wherein the sterile air is injected into the compartments and wherein the speed of the nitrogen gas injected is greater than the speed of the sterile air injected.

6. A process according to claim 3 or 4 wherein the nitrogen gas is injected at a flow rate of between 100 l/min and 800 l/min.

7. A process according to claim 5 wherein the nitrogen gas is injected at a flow rate of between 100 l/min and 800 l/min.

8. A process according to claim 5 wherein the nitrogen gas is injected into the package headspace for about one second.

9. A process according to claim 6 wherein the nitrogen gas is injected into the package headspace for about one second.

10. An apparatus according to claim 1 or 2 wherein the nozzle has a width for directing a stream of the gas having a width transverse to the package travel direction greater than the width of a package opening.

11. A process according to claim 3 wherein the nitrogen gas is ejected continuously.

12. A process according to claim 3 wherein the nitrogen gas is ejected discontinuously.

* * * * *

UNITED STATES PATENT AND TRADEMARK OFFICE

CERTIFICATE OF CORRECTION

PATENT NO. : 5,896,727

DATED : April 27, 1999

INVENTOR(S) : Josef EGLI, *et al.*

It is certified that error appears in the above-indentified patent and that said Letters Patent is hereby corrected as shown below:

Column 2, line 4, delete "us" and insert therefor -- is --.

Claim 3, line 9 (col. 4, ln. 22) delete "atmosphere" and insert therefor -- atmospheric --.

Claim 10, line 1 (col. 4, ln. 51) delete "apparatus" and insert therefor -- process -- and delete "1 or 2" and insert therefor -- 3 or 4 --

Signed and Sealed this

Fourth Day of January, 2000

*Attest:*

*Attesting Officer*

*Acting Commissioner of Patents and Trademarks*